United States Patent [19]

Ohta et al.

[11] 4,132,926

[45] Jan. 2, 1979

[54] ELECTRONIC FLASH DEVICES

[75] Inventors: Yoshiharu Ohta, Izumi; Hiroshi Hosomizu, Osaka, both of Japan

[73] Assignee: Minolta Camera Kabushiki Kaisha, Osaka, Japan

[21] Appl. No.: 780,176

[22] Filed: Mar. 22, 1977

[30] Foreign Application Priority Data

Mar. 26, 1976 [JP] Japan ..... 51-37457[U]

[51] Int. Cl.[2] ..... H05B 41/32

[52] U.S. Cl. ..... 315/241 P; 315/135; 354/127

[58] Field of Search ..... 315/129, 136, 241 P, 315/135; 320/1; 354/127

[56] References Cited

U.S. PATENT DOCUMENTS

| | | | |
|---|---|---|---|
| 3,764,849 | 10/1973 | Ohta | 315/241 P |
| 3,814,985 | 6/1974 | Pecher et al. | 315/241 P |
| 3,890,538 | 6/1975 | Iwata et al. | 315/241 P |
| 3,919,594 | 11/1975 | Mahlich et al. | 315/241 P |

FOREIGN PATENT DOCUMENTS

| | | | |
|---|---|---|---|
| 1073625 | 1/1960 | Fed. Rep. of Germany | 315/241P |

*Primary Examiner*—Eugene R. LaRoche
*Attorney, Agent, or Firm*—Watson, Cole, Grindle & Watson

[57] ABSTRACT

In an electronic flash device, wherein electrical energy stored by a main capacitor and an electronic flash tube is fired by the stored energy, a relaxation oscillator is adapted to oscillate when the main capacitor is charged to a given voltage level, which is a condition for completion of preparation for flash tube operation. The relaxation oscillator includes a capacitor, a glow discharge tube, and a resistor and the oscillation thereof causes intermittent glow discharge through the glow discharge tube for indicating the completion of preparation for flash tube operation. The electronic flash tube is triggered to emit a light flash by the stored energy of the relaxation oscillator capacitor. Excitation of the flash device, even with a power supply switch open, is prevented by isolating the main capacitor from the trigger capacitor and also from the glow discharge tube to also prevent an indication of flash preparation. The trigger capacitor is also discharged through the resistor to prevent actuation of the flash device should the flash synchro switch be closed with the power supply switch open.

7 Claims, 4 Drawing Figures

FIG. 1A
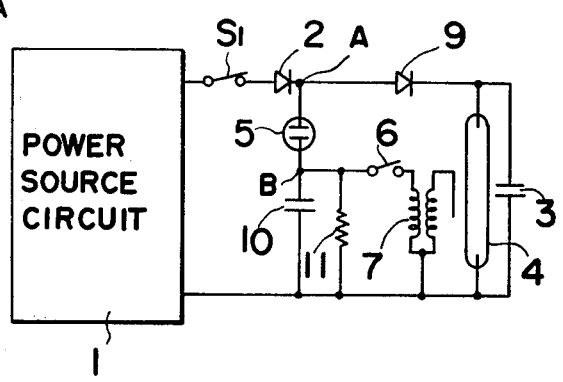
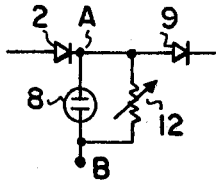
FIG. 1B
FIG. 2
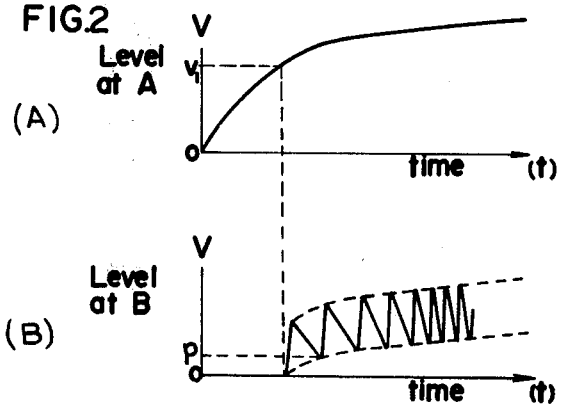
FIG. 3
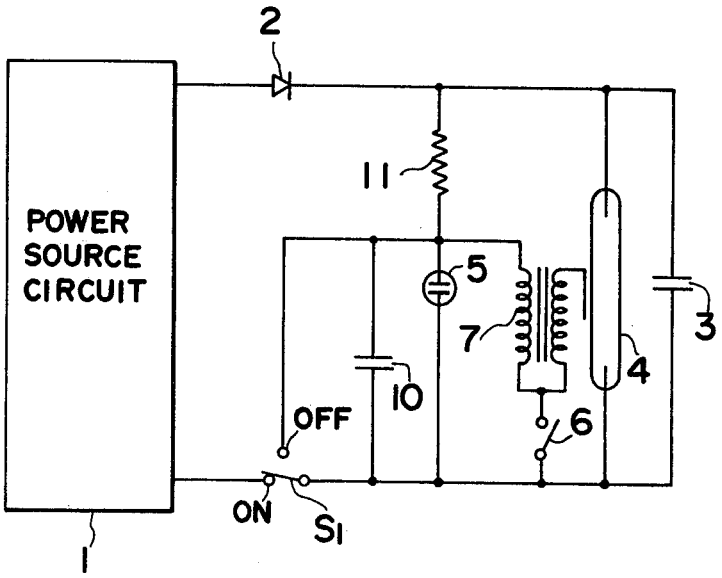

ELECTRONIC FLASH DEVICES

BACKGROUND OF THE INVENTION

1. Field of the invention

This invention relates to electronic flash devices, and more particularly to electronic flash device circuitry having means for triggering the flashing and means for indicating the completion of preparation for flash tube operation by an oscillatory signal generated by an oscillator circuit.

2. Description of the prior art

In the field of electronic flash devices, it is known to indicate the completion of preparation for flash tube operation by using a glow discharge tube. It is also known to provide a relaxation oscillator consisting of a glow discharge tube, a capacitor and a resistor for indicating the completion of preparation for flash tube operation by means of intermittent glow discharge through the glow discharge tube. However, in such prior art circuitry, an additional trigger capacitor is used to fire the flash tube.

SUMMARY OF THE INVENTION

It is an object of the present invention to provide a simplified electronic flash device which causes intermittent glow discharge through a glow discharge tube by using a minimum number of elements for indicating the completion of preparation for flash tube operation.

According to the present invention, the aforesaid object may be readily attained in an electronic flash device, by a relaxation oscillator including a capacitor, a glow discharge tube and a resistor to cause intermittent glow discharge through the glow discharge tube for indicating the completion of preparation for flash tube operation, but the electronic flash tube is also triggered to emit a flash from the stored energy of the relaxation oscillator capacitor.

The advantages resulting from the electronic flash device arranged as described above are as follows:

In general, an electronic flash device necessitates the use of a triggering capacitor for triggering the flash tube to emit a flash from the stored energy in the triggering capacitor. However, according to the present invention, the flash tube is triggered to emit a flash from the stored energy of a capacitor included in a relaxation oscillator circuit, thereby eliminating a separate triggering capacitor. Stated differently, according to the present invention, a relaxation oscillator is constructed by utilizing a triggering capacitor for firing a flash tube.

Prior art electronic flash devices provided with a relaxation oscillator require two capacitors, i.e., one for the relaxation oscillator, and the other for the triggering function, whereas the electronic flash device according to the present invention requires only one capacitor for the two functions.

The present invention provides another advantage, in that the readiness of the triggering means to trigger the flash tube operation may be confirmed by the intermittent glow discharge through the glow discharge tube. This results from the fact that the oscillation of the relaxation oscillator uses the electrical energy stored by the triggering capacitor to trigger the flashing of the flash tube. Stated in different manner, both the indicating and triggering operations are prevented by discharging the triggering capacitor in case that a user changes his mind to photograph without a flash light.

BRIEF DESCRIPTION OF THE DRAWINGS

FIG. 1A is a circuit diagram illustrative of one embodiment of an electronic flash device including a relaxation oscillator according to the present invention;

FIG. 1B is a circuit diagram of a portion of the circuit of FIG. 1A showing a means for varying the oscillation frequency of the relaxation oscillator;

FIGS. 2A, 2B are graphical presentations illustrative of the operation of the embodiment of FIG. 1; and FIG. 3 is a circuit diagram showing another embodiment of the invention.

DESCRIPTION OF THE PREFERRED EMBODIMENTS

In the circuit of FIG 1, when switch S1 is closed, then the high voltage of power source circuit 1 is impressed on main capacitor 3 through diodes 2, 9 connected in series with switch S1. A series connection of glow discharge tube 5, such as a neon tube, and triggering capacitor 10 is connected to junction A between diodes 2 and 9, in parallel with power source circuit 1. Resistor 11 and the primary side of trigger transformer 7 are connected in parallel with capacitor 10, with synchro-switch 6 closed between resistor 11 and the primary side of trigger transformer 7. Glow discharge tube 5, capacitor 10 and resistor 11 form a relaxation oscillator circuit.

FIGS. 2A, 2B respectively represent the relationship of the voltage levels at junction A and B of FIG. 1 as a function of time. When main switch S1 is closed, the voltage level at junction A begins to increase in accordance with the charging of main capacitor 3, as shown in FIG. 2A. The level at junction A will finally reach the output voltage level at power source circuit 1. However, glow discharge tube 5 remains non-conductive, until the voltage level at junction A reaches voltage v1 as shown in FIG. 2A, and then it becomes conductive and is fired by means of glow discharge therethrough when the voltage level at junction A reaches voltage v1. When glow discharge tube 5 is fired and becomes conductive, then capacitor 10 is charged, so that the voltage level at junction B rapidly increases as shown in FIG. 2B. This lowers the voltage across junctions A and B (also the voltage across glow discharge tube 5) and when the voltage across junctions A and B is lowered below the discharge-supporting voltage of glow discharge tube 5, then it becomes non-conductive and is extinguished. Under the above condition, capacitor 10 is discharged through resistor 11, so that the voltage between junctions A and B increases. When the voltage between junctions A and B reaches the discharge-initiating-voltage level for glow discharge tube 5, then it becomes conductive again. Thus, the voltage level at junction B varies, following the saw-tooth pattern as shown in FIG. 2B so that glow discharge tube 5 provides an intermittent glow discharge. The intermittent glow discharge of glow discharge tube 5 is initiated, when main capacitor 3 is charged to a voltage level v1, so that the readiness of main capacitor 3 to energize flash tube 4 is thereby indicated. The voltage at junction B oscillates thereafter above minimum voltage level P, as shown in FIG. 2B. Voltage P is also sufficient to trigger flash tube 4 through transformer 7. Under the above condition, when synchro-switch 6 is closed, then trigger capacitor 10, which is charged to at least voltage level P, is discharged through the primary side of trigger transformer 7, thereby triggering electronic flash tube 4 so as to emit a flash of light.

As is clear from the foregoing description, the present invention is based on the discovery that the voltage of capacitor 10, which varies according to the oscillation of the relaxation oscillator, is maintained above that predetermined lowest voltage level, whereby flash tube 4 may be triggered to emit a flash of light by the discharging of capacitor 10. Thus, the relaxation oscillator circuit and the triggering circuit are simplified over such a circuit arrangement using two capacitors.

As is evident from FIGS. 2A, 2B, the higher voltage to which the main capacitor is charged, the greater the oscillating frequency of the relaxation oscillator. The increase of the frequency of the oscillation is saturated when the voltage of the main capacitor reaches the output voltage of the power source circuit. Thus, the saturated frequency of the oscillation is indicative of the output voltage of the power source circuit which depends on a power source battery included therein. This means that the surviving energy of the power source battery included in power source circuit 1 may be determined from the flashing frequency of glow discharge tube 5.

With the embodiment of FIG. 1, when switch S1 is opened after the use of an electronic flash device, then power is no longer supplied through diode 2 to junction A, so that capacitor 10 is discharged through resistor 11, and may be maintained at a zero charge level thereafter. Thus, glow discharge tube 5 is extinguished. Further, even if synchro-switch 6 is inadvertently closed, electronic flash tube 4 will not be triggered to emit light. Diode 9 isolates junction A and the relaxation oscillator from main capacitor 3 when switch S1 is opened. As a result, even if a residual charge remains on main capacitor 3, glow discharge tube 5 is extinguished, at the time when switch S1 is opened. Diode 9 thereby prevents the discharge of main capacitor 3, even if switch S1 is opened, with the result that, when the electronic flash device is used again, the residual charges remaining in main capacitor 3 may be effectively utilized.

FIG. 3 shows another embodiment of the electronic flash device according to the present invention in which like elements are designated like reference numerals in common with the embodiment of FIG. 1. When switch S1 is at the ON contact, then the charging of main capacitor 3 is commenced, whereupon triggering capacitor 10 is charged through resistor 11. When the voltage of triggering capacitor 10 reaches the discharge-initiating voltage for glow discharge tube 5, then triggering capacitor 10 is discharged through the glow discharge of glow discharge tube 5. At this time, the voltage of main capacitor 3 reaches a given level. When the voltage of triggerng capacitor 10 is lowered, by means of discharge through glow discharge tube 5, below the discharge-supporting level for glow discharge tube 5, then it is extinguished, while the charging of triggering capacitor 10 is initiated again through resistor 11.

In this manner, when the voltage of main capacitor 3 reaches a given voltage level, the relaxation oscillator begins to oscillate. The voltage of triggering capacitor 10 varies according to the oscillation of the relaxation oscillator. However, triggering capacitor 10 is maintained at least at the discharge-supporting voltage of glow discharge tube 5, which voltage is sufficient, so that with the closure of synchro-switch 6, a sufficient current is supplied to the primary side of trigger transformer 7 to trigger the electronic flash tube so as to emit a flash of light. When switch S1 is on the OFF contact, the supply of power from power source circuit 1 is interrupted, while triggering capacitor 10 is short-circuited to be discharged, so that glow discharge tube 5 is extinguished. Therefore, flash tube 4 will not be triggered, even if synchro-switch 6 is closed.

In the embodiment of FIG. 1, glow discharge tube 5 is provided as a charging path to capacitor 10, whereas glow discharge tube 5 is provided as a discharging path in the embodiment of FIG. 3. It is apparent from the above embodiments that the present invention is applicable regardless of the type of the relaxation oscillator. If necessary, an additional resistor 12 can be connected in parallel with glow discharge tube 5 for adjusting the period of oscillation of the relaxation oscillator.

What is claimed is:

1. An electronic flash device comprising:

an electronic flash tube for producing light flashes;

a main capacitor for storing electrical energy to be discharged through said electronic flash tube;

a power source circuit for supplying said main capacitor with electrical energy;

means for indicating the charging of said main capacitor above a predetermined level, and including a second capacitor, a glow discharge tube and a resistor forming a relaxation oscillator adapted to oscillate with said main capacitor charged above said predetermined level, said second capacitor and said resistor forming a parallelly connected circuit, said glow discharge tube and said parallelly connected circuit being connected in series with one another and in parallel with said main capacitor and said oscillation being observable from the intermittent glow discharge through said glow discharge tube;

means for triggering the flashing of said electronic flash tube with discharge current from said second capacitor;

a main switch means for switching said power source circuit between a first condition for supplying said main capacitor with electrical energy and a second condition for not supplying said main capacitor with electrical energy; and means for preventing said indicating means from indicating and also for preventing said triggering means from triggering said flash device with said main switch means in said second condition, said preventing means including a diode connected between said main capacitor and said relaxation oscillator for preventing said main capacitor from supplying said relaxation oscillator with electrical energy with said main switch means in said second condition.

2. An electronic flash device as in claim 1 wherein the minimum voltage to which said second capacitor is charged during oscillation of said relaxation oscillator is greater than the lowest voltage level at which said flash tube is triggerable to emit a flash of light.

3. An electronic flash device as in claim 1 wherein the oscillation frequency of said relaxation oscillator increases with increasing voltage to which said main capacitor is charged, and said relaxation oscillator having a saturation frequency dependent on the voltage of said power source circuit, thereby enabling determination of the condition of said power source circuit by observation of said relaxation oscillation frequency.

4. An electronic flash device as in claim 1 wherein said means for triggering includes a transformer having a primary winding responsive to said discharge current.

5. An electronic flash device as in claim 1 wherein said relaxation oscillator further includes a variable resistor connected in parallel with said glow discharge tube for adjusting the relaxation oscillator frequency.

6. An electronic flash device as in claim 2 wherein said means for triggering includes a transformer having a primary winding responsive to said discharge current.

7. An electronic flash device as in claim 6 wherein said relaxation oscillator further includes a variable resistor connected in parallel with said glow discharge tube for adjusting the relaxation oscillator frequency.

* * * * *